US007088941B2

(12) United States Patent
Kabashima et al.

(10) Patent No.: US 7,088,941 B2
(45) Date of Patent: Aug. 8, 2006

(54) IMAGE FORMING APPARATUS HAVING A TRANSFER-EXPOSURE DEVICE, AND IMAGE FORMING METHOD THEREOF

(75) Inventors: Hirotaka Kabashima, Tachikawa (JP); Kouki Takahashi, Higashiyamoto (JP)

(73) Assignee: Konica Minolta Holdings, Inc., Tokyo (JP)

( * ) Notice: Subject to any disclaimer, the term of this patent is extended or adjusted under 35 U.S.C. 154(b) by 238 days.

(21) Appl. No.: 10/751,909

(22) Filed: Jan. 7, 2004

(65) Prior Publication Data

US 2004/0136756 A1 Jul. 15, 2004

(30) Foreign Application Priority Data

Jan. 10, 2003 (JP) ..... 2003-004321

(51) Int. Cl.
*G03G 15/16* (2006.01)
*G03G 21/00* (2006.01)

(52) U.S. Cl. ..... 399/128; 399/296

(58) Field of Classification Search ..... 399/128, 399/296, 310, 311, 314, 315
See application file for complete search history.

(56) References Cited

U.S. PATENT DOCUMENTS 4,785,324 A * 11/1988 Yamazaki et al. ..... 399/128
5,347,353 A * 9/1994 Fletcher ..... 399/296

* cited by examiner

*Primary Examiner*—William J. Royer
(74) *Attorney, Agent, or Firm*—Finnegan, Henderson, Farabow, Garrett & Dunner, L.L.P.

(57) ABSTRACT

An image forming apparatus having a photoconductor for carrying a toner image; a transfer device, provided with a discharge wire, for transferring the toner image onto a transfer material through discharge in a transfer area, after a transfer material is superposed with the photoconductor; a transfer-exposure device for carrying out light exposure of a surface of the photoconductor superposed with the transfer material, in the transfer area; a separator for separating the transfer material from the photoconductor after the toner image is transferred; and a controller for controlling the image forming apparatus. The controller controls such that light from the transfer-exposure device is applied to the photoconductor surface for the first time when the photoconductor surface superposed with the transfer material has reached the transfer area.

5 Claims, 4 Drawing Sheets

IMAGE FORMING APPARATUS HAVING A TRANSFER-EXPOSURE DEVICE, AND IMAGE FORMING METHOD THEREOF

BACKGROUND OF THE INVENTION

The present invention relates to an image forming method and an image forming apparatus such as a copying machine, printer and facsimile, and in particular to an image forming apparatus configured in such a way that the photoconductor surface is exposed at the time of transfer of a toner image.

One of the well-known image forming apparatuses performs a method that comprises steps of: forming an electrostatic latent image on a uniformly charged photoconductor surface by exposure means; forming the electrostatic latent image into a toner image using development means with toner carried thereon; transferring the toner image onto a transfer material fed to a transfer area, from the photoconductor by transfer means; separating the transfer material from the photoconductor using separation means; feeding the transfer material to a fixing apparatus; fixing the toner image by application of heat and pressure; and ejecting the transfer material to a tray installed outside the apparatus by ejecting means.

It is also known that exposure is performed before or concurrently with transfer in order to improve transfer efficiency and separation performances when the toner image is transferred on the transfer material.

For example, a technique is disclosed, where light is applied from a light source provided inside a transfer electrode simultaneously with application of an electric field, and transfer is carried out while removing electric charges on a photoconductor (Patent Document 1).

However, the simultaneous transfer-exposure lamp disclosed in Patent Document 1 is arranged in such a way as to apply light to a range beyond the area where the electric discharge extends by the application of a voltage to the transfer electrode (hereinafter referred to as "transfer area"), namely, to the range outside the area close to the transfer electrode where an attraction force effectively acts on toner. Because of this configuration, due to reduction of potential, the toner absorbed on the surface of the photoconductor by electrostatic adsorption is put in an easily movable state, with the result that so-called scattering is likely to occur. (FIG. 6 shows an example where the simultaneous transfer-exposure lamp is applied to the point beyond the range where electric discharge from the transfer electrode generates effectively a suction force of toner. FIG. 6 will be explained later in details).

What is called scattering here refers to the condition where the transfer material and photoconductor are not brought into close contact with each other, and when the photoconductor is exposed through the transfer material and electric charge is eliminated during action of the transfer electrode, part of the toner is transferred from the photoconductor to a position where transfer should not be performed, with the result that disturbance (scattering) has occurred to the final image.

A method for avoiding the aforementioned scattering is found in the disclosed technology related to the image forming apparatus equipped with illumination range limiting means for ensuring that the exposed light of the simultaneous transfer-exposure apparatus where light is applied simultaneously with transfer will not be applied to the photoconductor before the transfer material is brought into contact with the photoconductor (Patent Document 2). The overview of Patent Document 2 is shown below:

(1) Provide illumination range limiting means for ensuring that the exposed light of the simultaneous transfer-exposure apparatus will not be applied to the photoconductor before the transfer material is brought into contact with the photoconductor.

(2) Provide alternating current charging means for ensuring that alternating current charging is applied to the photoconductor and toner prior to transfer.

FIG. 8 is a cross sectional view representing the example of the image forming apparatus disclosed in Patent Document 2. Numeral 1*a* denotes a transparent photoconductor belt. A simultaneous transfer-exposure lamp 6 and its lightproof plate 61 are provided inside the transparent photoconductor belt 1*a*. Arrangements are made in such a way the light of the simultaneous transfer-exposure lamp 6 is applied to the transparent photoconductor belt 1*a* simultaneously with transfer, after a transfer material P fed through transfer material feed path 11 comes into contact with the transparent photoconductor belt 1*a*. To put it another way, the light of the simultaneous transfer-exposure lamp 6 is blocked by the lightproof plate 61 before the transfer material P contacts the transparent photoconductor belt 1*a* so that light is not applied to the transparent photoconductor belt 1*a*. This structure prevents the aforementioned scattering phenomenon from occurring.

However, according to the aforementioned art (1), a lightproof plate 61 is provided to ensure that light of the simultaneous transfer-exposure lamp 6 will not be applied to the transparent photoconductor belt 1*a* before the transfer material P comes into contact with the transparent photoconductor belt 1*a*. After the transfer material P has come into contact with the transparent photoconductor belt 1*a*, the transparent photoconductor belt 1*a* is exposed before transfer discharge by a transfer apparatus 5 is applied to the transfer material P. Accordingly, electric charge is eliminated from the transparent photoconductor belt 1*a* during this time. This leads to toner scattering around the image.

According to the aforementioned art (2), electric charge on the transparent photoconductor belt 1*a* is removed by alternating current charging before transfer. Accordingly, scattering of toner to the surrounding area occurs, similarly to the case of the aforementioned art (1).

To reduce the scattering of toner, it is effective to reduce the amount of light of the simultaneous transfer-exposure lamp 6 and the amount of alternating current electrical charge before transfer. In this case, however, originally intended improvement of the transfer efficiency or separation performance cannot be achieved.

Especially when copying on the back side where transfer is performed on the transfer material corrugated by heat and pressure after passing through a fixing apparatus, or when it is comparatively difficult to get a close contact with the photoconductor as in the last end portion of the material and there is a large-scale corrugation of the transfer material, there are such problems as conspicuous scattering of toner at the time of transfer and bleeding of characters.

In a copying machine or printer of digital exposure type based on a laser and LED rapidly coming into widespread use in recent years, halftone images are often reproduced using a dot-based image. When toner has scattered around the dot forming a grid of dots, the image density appears high and this will lead to occurrence of uneven density in the halftone image.

When a toner image is formed on the back side after a toner image is formed on the front side of the transfer material, and a halftone image is formed by dots on the back side, toner scatters in the portion without toner on the front surface. Whereas the amount of light reaching the photoconductor is reduced in the portion with toner on the front surface and this results in reduced scattering of toner. And this portion appears pale, and a faulty image such as a so-called ghost will be produced.

[Patent Document 1]

Official Gazette of Jikkosho 1965-17412 (FIG. 3 on Page 1)

[Patent Document 2]

Official Gazette of Tokkaihei 1994-175440 (FIG. 1, paragraph 0016)

The object of the present invention is to solve the aforementioned problems and to provide an image forming method and an image forming apparatus, characterized by excellent transfer efficiency and separation performance, capable of preventing scattering of toner from occurring at the time of transfer and capable of getting a high-quality image, free from bleeding of characters or irregularity of density on the halftone image formed by dots, or ghost on the back side caused by the presence or absence of a toner image on the front side surface.

SUMMARY OF THE INVENTION

The aforementioned object can be achieved by the features of the present invention described in the followings:

(1) An image forming apparatus comprising: a photoconductor being movable for carrying a toner image; a transfer device, provided with a discharge wire, for transferring the toner image onto a transfer material through discharge from the discharge wire in a transfer area, after a transfer material is superposed with the photoconductor; a transfer-exposure device for carrying out light exposure of a surface of the photoconductor superposed with the transfer material, from the back of the transfer material in the transfer area, the transfer area being an area where discharge from the discharge wire is applied onto the surface of the photoconductor; a separator for separating the transfer material from the photoconductor after the toner image is transferred; and a controller for controlling the operation of the image forming apparatus;

Wherein, the controller controls such that light from the transfer-exposure device is applied to the photoconductor surface for the first time when the photoconductor surface superposed with the transfer material has reached the transfer area.

(2) An image forming apparatus comprising: a photoconductor being movable for carrying a toner image; a transfer device, provided with a discharge wire, for transferring the toner image onto a transfer material through discharge from the discharge wire in a transfer area, after a transfer material is superposed with the photoconductor; a transfer-exposure device for carrying out light exposure of a surface of the photoconductor superposed with the transfer material from the back of the transfer material in the transfer area, the transfer area being an area where discharge from the discharge wire is applied onto the surface of the photoconductor; a separator for separating the transfer material from the photoconductor after the toner image is transferred; and a controller for controlling the operation of the image forming apparatus;

wherein, distribution of an amount of light on the photoconductor surface from the transfer-exposure device, when the photoconductor surface superposed with the transfer material has reached the transfer area, is arranged such that an integrated value of an amount of exposed light upstream of the point where the photoconductor surface is closest to the discharge wire, in a direction of movement of the photoconductor, is 10 through 30% of a total amount of exposed light from the transfer-exposure device, and the end of the exposed light in the upstream side on the photoconductor is within the transfer area.

(3) The image forming apparatus according to (1) or (2), further comprising a light blocking member, provided between the transfer-exposure device and the photoconductor, for blocking a part of light from the transfer-exposure device.

(4) An image forming method comprising the steps of: forming a toner image on a photoconductor being movable; superposing a transfer material with the photoconductor; transferring the toner image onto the transfer material by discharging from a discharge wire in a transfer area, exposing, with light from a transfer-exposure device, a surface of the photoconductor superposed with the transfer material, from the back of the transfer material in the transfer area, the transfer area being an area where discharge from the discharge wire is applied onto the surface of the photoconductor; and separating the transfer material from the photoconductor after transferring the toner image;

wherein, light from the transfer-exposure device is applied to the surface of the photoconductor for the first time when the surface of the photoconductor superposed with the transfer material has reached the transfer area.

(5) The image forming method according to (4), wherein distribution of an amount of light on the surface of the photoconductor from the transfer-exposure device, when the surface of the photoconductor superposed with the transfer material has reached the transfer area, is arranged such that an integrated value of an amount of exposed light upstream of the point where the surface of the photoconductor is closest to the discharge wire, in the direction of movement of the photoconductor, is 10 through 30% of a total amount of exposed light from the transfer-exposure device, and the end of the exposed light on the upstream side is within the transfer area.

DETAILED DESCRIPTION OF THE PREFERRED EMBODIMENT

Figure 1:
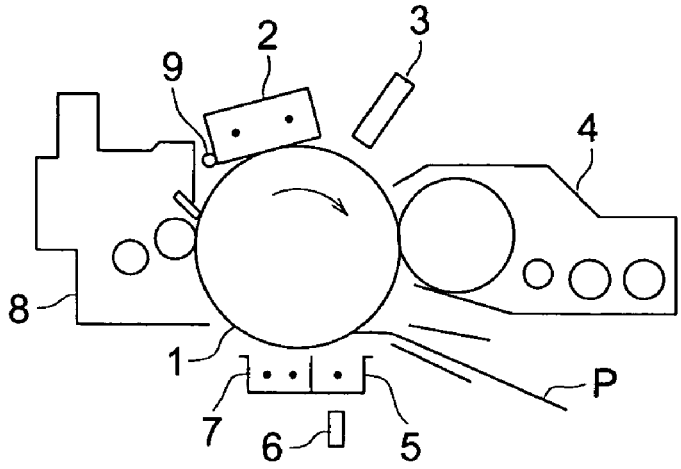
FIG. 1 is a schematic diagram representing a major configuration of an image forming apparatus such as a copying machine.

The following describes the preferred embodiments of the present invention with reference to the drawings:

FIG. 1 is a schematic diagram representing the major configuration of an image forming apparatus such as a copying machine. In FIG. 1, a photoconductor drum 1 (hereinafter referred to as "photoconductor") is a photoconductive cylindrical rotary body, which rotates in the clockwise direction. The photoconductor 1 is surrounded by an arrangement of:

a charging apparatus 2 for uniformly charging the surface of the photoconductor 1 sequentially in the rotary direction of the photoconductor 1;

exposure means 3 for forming an electrostatic latent image by applying light in conformity to image data on the charged photoconductor 1;

a development apparatus 4 for forming a toner image by supplying toner to the electrostatic latent image formed on the photoconductor 1;

a transfer material P in contact with the photoconductor 1;

a transfer apparatus 5 for transferring the toner image on the photoconductor 1 onto the transfer material P;

a transfer-exposure apparatus 6, arranged on the back surface of the transfer apparatus 5, for applying light to the surface of the photoconductor 1;

a separator apparatus 7 for separating the transfer material P subsequent to transfer;

a cleaning apparatus 8 for removing toner remaining on the surface of the photoconductor 1 after transfer; and a pre-charging exposure lamp 9 (hereinafter referred to as "PCL") for removing residual potential from the surface of the photoconductor 1.

The following describes the operation of the image forming apparatus of the present embodiment:

The control means (not illustrated) incorporated in the image forming apparatus receives an image formation start signal by means of such an input signal as the ON signal of a copy switch (not illustrated) and sends an electric signal to the drive means of a photoconductor drive motor not illustrated, thereby driving the photoconductor 1. At the same time, it causes a pre-charging exposure lamp (PCL) 9 to light up in order to remove the influence of the potential on the surface of a front image formed on the photoconductor 1. Then the surface of the photoconductor 1 is charged by the charging apparatus 2. The charging apparatus 2 is a scorotron or corotron charging device equipped with a discharge wire, and is provided with a high voltage power supply (not illustrated) for applying voltage to the charging device. The high voltage power supply output voltage is controlled by the aforementioned control means in such a way that the surface of the photoconductor 1 is uniformly charged.

While continuing rotation, the photoconductor 1 whose surface is charged by the charging apparatus 2 is exposed image-wise by the exposure means 3, thereby forming an electrostatic latent image. The exposure means 3 is provided by a laser exposure system and a scanning method according to the LED-based exposure method.

The photoconductor 1 with latent image formed thereon continues further rotation and reaches the development apparatus 4. The aforementioned electrostatic latent image is developed into a toner image by the development apparatus 4. The development apparatus 4 contains a developer carrier (not illustrated) that holds a two-component developer composed of toner and carrier and feeds the developer by rotation, and a development bias power supply (not illustrated) that applies high voltage to the developer carrier, the output voltage ranging from 0 through −1,000 volts.

The photoconductor 1 with a toner image formed thereon by the development apparatus 4 continues a further rotation to reach the transfer area. A toner image on the transfer material P is transferred through the functions of the transfer apparatus 5 and transfer-exposure apparatus 6. The transfer material P subsequent to transfer is separated from the photoconductor 1 by the separator apparatus 7, and is ejected to an ejection tray after having been heated and fixed by a fixing apparatus (not illustrated). The remaining toner on the photoconductor 1 separated from the transfer material P is removed by the cleaning apparatus 8.

Figure 2:
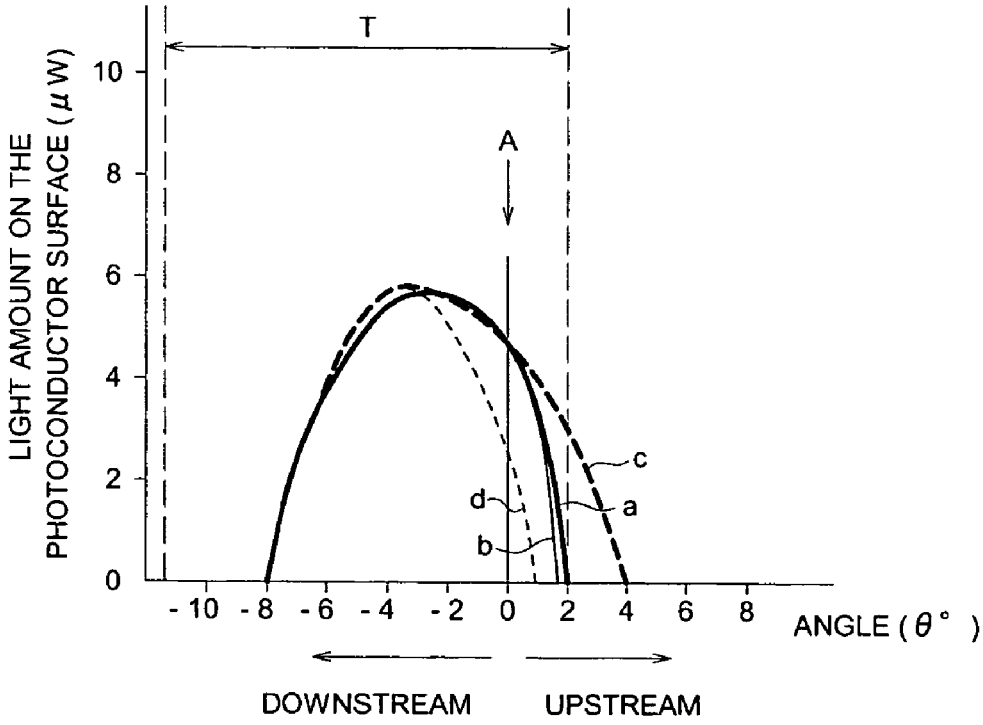
FIG. 2 is a graph representing a distribution of an amount of light, obtained by measuring and plotting the amount of light on a photoconductor surface due to a transfer-exposure apparatus.
Figure 3:
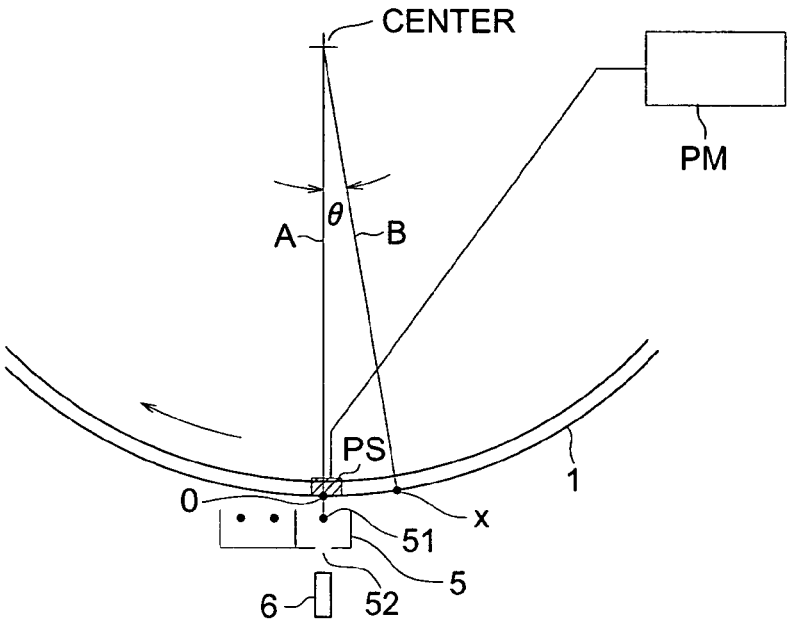
FIG. 3 is a schematic cross sectional view representing an embodiment for measuring an amount of light on the surface of a photoconductor.

FIG. 2 is a graph representing the distribution of the amount of light, obtained by measuring and plotting the amount of light on the photoconductor surface from the transfer-exposure apparatus. FIG. 3 is a schematic cross sectional view representing an embodiment for measuring the amount of light on the surface of a photoconductor 1.

In FIG. 2, the vertical axis represents the amount of light (measurement method to be described later) on the surface of a photoconductor, and a point "x" in FIG. 3 is expanded on the horizontal axis. The point "x" being inscribed on the surface of the photoconductor 1 is assigned on a line using a line B formed by a center angle θ° with respect to a line A, assuming that "0" (zero) stands for the crossing point between the surface of the photoconductor 1 and the line A connecting between the discharge wire of the transfer apparatus 5 (in the case of two or more discharge wires, a discharge wire 51 located on the upstream side in the direction of the photoconductor rotation) and the center of the photoconductor 1 (FIG. 3). The amount of light on the surface of the photoconductor 1 due to the transfer-exposure apparatus 6 is measured and plotted for the first and second embodiments of the present invention, as well as the first and second comparative examples. FIG. 2 is a graph representing the distribution of the amount of light, as shown above. In FIG. 2, a positive value on the horizontal axis is given on the upstream side in the direction of photoconductor rotation (indicated by an arrow) (called "upstream side" for short) in FIG. 3, and a negative value on the horizontal axis is shown on the downstream side in the direction of photoconductor rotation (indicated by an arrow) (called "downstream side" for short). The curve "a" represented by the solid bold line shows the distribution of light amount obtained by measuring and plotting the amount of light on the surface of the photoconductor 1 as the first embodiment of the present invention. The curve "b" indicated by the solid line denotes the distribution of light amount in the second embodiment of the present invention, the curve "c" indicated by the bold dashed line shows that in the first comparative example according to the prior art, and the curve "d" represented by the dashed line represents that in the second comparative example according to the prior art. "T" shows the discharge area from the transfer electrode (transfer area).

FIG. 3 shows the configuration in the method for measuring the amount of light on the surface of the photoconductor 1 according to the embodiment. As shown, the surface of the photoconductor 1 is provided with an opening, which receives a photosensor PS (Model AQ1974) connected to an optical power meter PM (Model AQ1135) manufactured by Ando Denki Co., Ltd., where this photosensor is fixed in position. Arrangements are made in such a way that the light receiving surface of the optical sensor PS is equalized with the surface of the photoconductor 1. Further, a transfer apparatus 5 equipped with a discharge wire 51 and opening slit 52 is arranged opposite to the surface of the photoconductor 1. In actual measurement, light is emitted from the transfer-exposure apparatus 6 arranged on the back of the transfer apparatus 5. While the photoconductor 1 is rotating, the output value (μW) of the optical power meter PM is read through the photosensor PS. This output value is plotted to create the graph given in FIG. 2.

FIG. 2 shows that scattering is likely to occur to the image since curve "c" extends into the area outside the transfer area T. Further, curves "a" and "b" are located inside the transfer area T, and the amount of light upstream from the line A connecting between the discharge wire 51 and the center of photoconductor 1 is greater than that of curve "d". This means the exposure works effectively during or before transfer. Curve "d" is located inside the transfer area, but the amount of light upstream from the line A is small. This leaves problems with improvement of transfer efficiency and separation performance as one of the objects of exposure during or before transfer.

Figure 4:
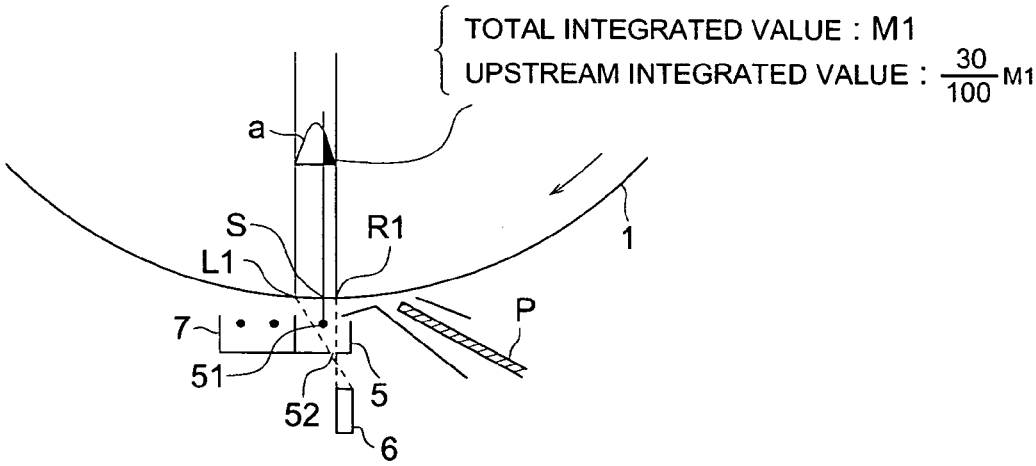
FIG. 4 is a schematic cross sectional view explaining a positional relationship between a transfer apparatus and transfer-exposure apparatus as a first embodiment of the present invention.
Figure 5:
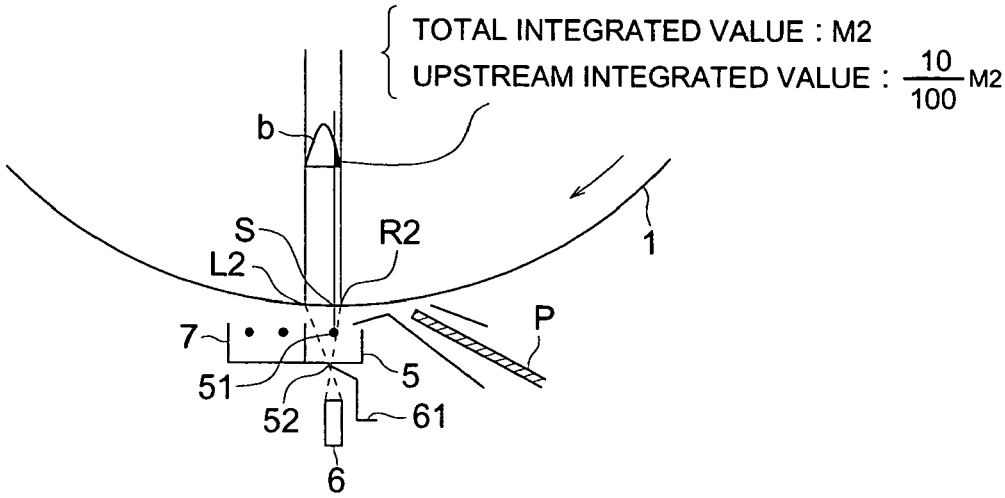
FIG. 5 is a schematic cross sectional view explaining a positional relationship between a transfer apparatus and transfer-exposure apparatus as a second embodiment of the present invention.

FIG. 4 is a schematic cross sectional view explaining the positional relationship between the transfer apparatus 5 and transfer-exposure apparatus 6 as a first Embodiment of the present invention. FIG. 5 is a schematic cross sectional view explaining the positional relationship between the transfer apparatus 5 and transfer-exposure apparatus 6 as a second embodiment of the present invention.

In FIG. 4, an opening slit 52 extending in the direction parallel to the direction of the extension of the discharge wire 51 is formed on the bottom surface of the transfer apparatus 5. The transfer-exposure apparatus 6 is arranged at a position opposite to the photoconductor 1, with the transfer apparatus 5 located in-between. Light from the transfer-exposure apparatus 6 is applied to the surface of the photoconductor 1 after passing through the opening slit 52.

The following describes the positional relationship between the transfer-exposure apparatus 6 and transfer apparatus 5 in the first embodiment with reference to FIG. 4: "S" (equivalent to point "0" in FIG. 3) is assumed to represent the closest contact point on the surface of the photoconductor 1 with the discharge wire 51. "R1" is assumed to represent the upstream side of the light applied to the surface of the photoconductor 1 from the transfer-exposure apparatus 6, in the direction of rotation of the photoconductor 1 (hereinafter referred to as "upstream side"), and "L1" is assumed to represent the downstream side end of the light on the downstream side in the direction of rotation of the photoconductor 1 (hereinafter referred to as "downstream side"). The total amount of light in the range from the upstream side end R1 on the surface of the photoconductor 1 to the downstream side end L1 is represented in terms of the value obtained by integrating the light amount distribution curve "a" from the upstream side end R1 to the downstream side end L1. When this integral value is represented in terms of light amount (total integrated value) M1, the position of the transfer-exposure apparatus 6 and the opening width of the opening slit 52 of the transfer apparatus 5 is set in such a way that the value (light amount) obtained by integration from the aforementioned closest point S to the upstream side end R1 (upstream integrated value) will be (30/100) M1. The position of the upstream side end R1 to be set here must be within the transfer range.

In FIG. 5, the opening slit 52 is arranged on the bottom surface of the transfer apparatus 5 and the transfer-exposure apparatus 6 is arranged at the position opposite to the photoconductor 1, with the transfer apparatus 5 located in-between. This arrangement is the same as that in FIG. 4. In FIG. 5, a lightproof plate 61 for determining the position of the light from the transfer-exposure apparatus 6 on the end portion R2 on the upstream side is arranged between the transfer apparatus 5 and transfer-exposure apparatus 6.

Similarly to the case of the first embodiment, let us assume that the positional relationship between transfer-exposure apparatus 6 and transfer apparatus 5 in the second embodiment is the same as that in the first embodiment, except for the lightproof plate 61. Also assume that the lightproof plate 61 determines the position of the light on the end portion R2 on the upstream side, "R2" represents the upstream side end of light applied to the surface of the photoconductor 1 from the transfer-exposure apparatus 6, and "L2" represents the downstream side end. Based on this assumption, the total amount of light in the range from the upstream side end R2 on the surface of the photoconductor 1 to the downstream side end L2 is represented in terms of the value (light amount) M2 obtained by integrating the light amount distribution curve "b" from the downstream side end L2 to the upstream side end R2, and the positions of the transfer-exposure apparatus 6 and transfer apparatus 5 and the opening width of the opening slit 52 are set in such a way that the integral value (light amount) from the aforementioned closest point S to the upstream side end R2 will be (10/100) M2. Similarly to the case of the first embodiment, the position of the upstream side end R2 must be within the transfer range.

Figure 6:
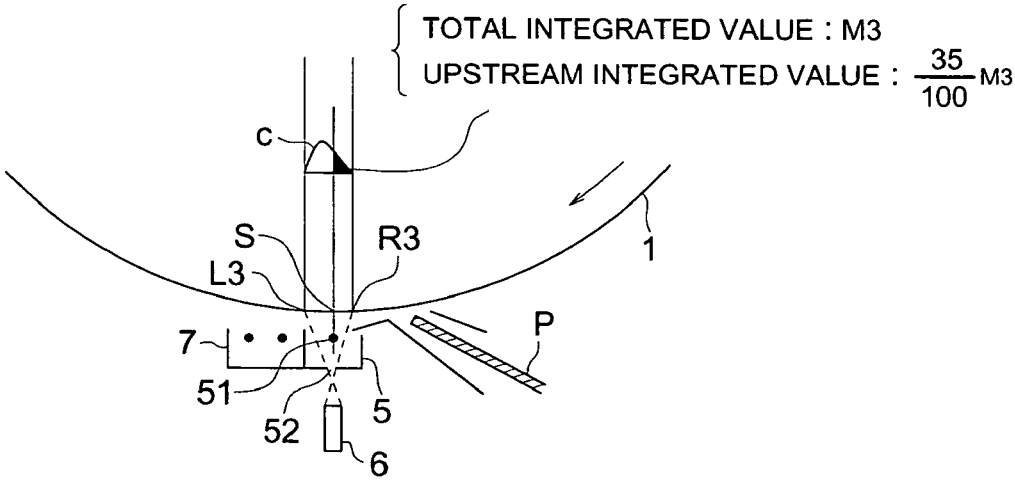
FIG. 6 is a schematic cross sectional view explaining a positional relationship between a transfer apparatus and transfer-exposure apparatus as a comparative example.
Figure 7:
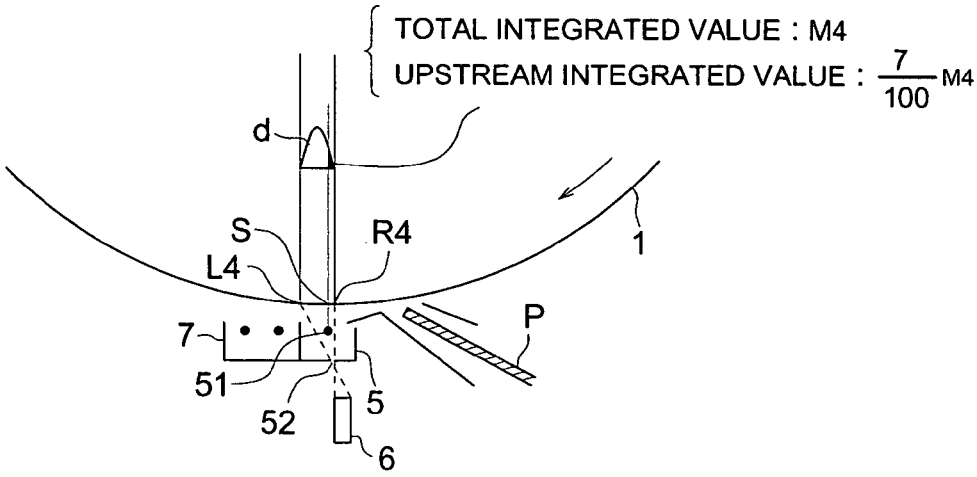
FIG. 7 is a schematic cross sectional view explaining the positional relationship between the transfer apparatus and transfer-exposure apparatus as another comparative example.
Figure 8:
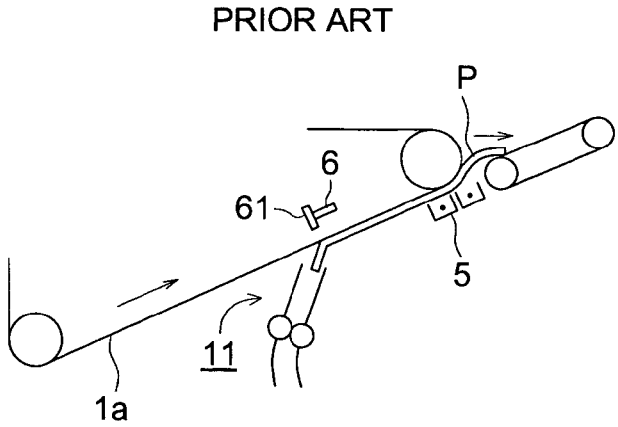
FIG. 8 is a cross sectional view representing an embodiment of an image forming apparatus in Patent Document 1.

FIGS. 6 and 7 are schematic cross sectional views explaining the positional relationship between the transfer apparatus 5 and transfer-exposure apparatus 6 according to comparative examples. FIG. 6 provides the first comparative example, and FIG. 7 the second one. In FIGS. 6 and 7, the constituent members of the image forming apparatus are the same as those in FIG. 4. The only difference is found in the positions of the transfer apparatus 5 and transfer-exposure apparatus 6. The same reference numerals will be used to represent the same constituent members, which will not be described to avoid duplication. However, in the first comparative example, light from the transfer-exposure apparatus 6 is applied to the surface of the photoconductor 1 even in the range (upstream side) outside the transfer area (see FIG. 2). In the second comparative example, even when the surface of the photoconductor 1 has contacted the transfer material P in the transfer area, the light from the transfer-exposure apparatus 6 is applied only to the vicinity of the closest point S to the discharge wire 51. In this respect, the first and the second comparative example are different from the first and second embodiments of the present invention. This difference will be described in detail with reference to FIGS. 6 and 7:

In FIG. 6 (first comparative example), assume that "M3" is used to represent the total amount of the light applied to the surface of the photoconductor 1 from the transfer-exposure apparatus 6 (to be calculated according to the same method as that in the first and second embodiments) in the range from the downstream side end L3 to the upstream side end R3. Then the positions of the transfer apparatus 5 and the transfer-exposure apparatus 6 and opening width of the opening slit 52 are set in such a way that the amount of light from the closest point S relative to the discharge wire 51 to the upstream side end R3 (to be calculated according to the same method as that in the first and second embodiments) will be (35/100) M3. In this comparative example, the light from the transfer-exposure apparatus 6 is applied to the upstream side end R3 on the surface of the photoconductor 1. This position is outside the transfer area, and the toner attraction force becomes less strong due to discharge of the discharge wire 51, with the result that the aforementioned scattering tends to occur.

In FIG. 7 (second comparative example), similarly to the first comparative example, assume that "M4" is used to represent the total amount of the light applied to the surface of the photoconductor 1 from the transfer-exposure apparatus 6 in the range from the downstream side end L4 to the upstream side end R4. Then the positions of the transfer apparatus 5 and the transfer-exposure apparatus 6 and opening width of the opening slit 52 are set in such a way that the amount of light from the closest point S relative to the discharge wire 51 to the upstream side end R4 will be (7/100) M4. In this comparative example, the light from the transfer-exposure apparatus 6 reaches only the upstream side end R4 on the surface of the photoconductor 1. This position is insufficient to ensure effective exposure on the upstream side at the time of transfer. Thus, the potential on the surface of the photoconductor 1 fails to come down sufficiently, with the result that both transfer efficiency and separation performance are reduced.

Table 1 shows the result of experiments conducted on the first and second embodiment of the present invention, and the first and second comparative examples.

TABLE 1

| | Upstream light amount (%) | Irregular dot density, character bleeding and ghost on back | Transfer efficiency (%) | Separation performance | Reference symbol in graph (FIG. 2) |
|---|---|---|---|---|---|
| 1st embodiment | 10 | Do not occur. | 96 | Good | a |
| 2nd embodiment | 30 | Do not occur. | 97 | Good | b |
| 1st comparative example | 35 | Occur | 98 | Good | c |
| 2nd comparative example | 7 | Do not occur. | 85 | Unstable | d |

(1) Image Forming Conditions

Photoconductor: Organic photoconductor drum using a titanylphthalocyan pigment having a diameter of 100 mm Photoconductor linear velocity: 420 mm/sec.

Photoconductor potential: Unexposed portion −750 volts; exposed portion −100 volts Development bias: −600 volts (reverse development)

Transfer current: 60 μA (current flowing to the photoconductor at the time of transfer discharge)

Alternating current for separation: 220 μA (current flowing to the photoconductor at the time of discharge by separation)

Direct current for separation: −50 μA (current flowing to the photoconductor at the time of discharge by separation)

(2) Evaluation Procedure

Irregular dot density: Visually check a 50%-dot halftone image to see if the irregular dot density is present or not.

Bleeding of character: Visually check a 5.5-point letter (alphabet) to see if bleeding is present or not.

Ghost on the back: Visually check the image to see if a ghost appears on the back or not when a 50%-dot halftone image is formed on the entire back surface after a 72-point letter has been printed on the front surface of a transfer material.

Transfer efficiency: Measure the mass of the toner transferred on the transfer material and the toner remaining after transfer on the photoconductor, and represent the mass of the toner transferred on the transfer material relative to the total mass of the toner in terms of percentage (%) to make comparison.

Separation performance: Check the separation performance using the bond paper having a basis weight of 64 $g/m^3$.

(3) Result

Satisfactory results were obtained in the first and second embodiments.

In the first comparative example, irregular dot density, character bleeding and back side ghost occurred due to the scattering of toner at the time of transfer.

In the second comparative example, the transfer efficiency was as low as 86%, and the transfer material was separated by nearly winding around the photoconductor. Separation performance was unstable (insufficient).

The aforementioned experiments have demonstrated that, if the aforementioned amount of light applied on the upstream side relative to the width of the light applied to the surface of the photoconductor 1 from the transfer-exposure apparatus 6 is 10 through 30 percent of the total amount of the light applied, there is no problem with scattering of the image, transfer efficiency and separation performance.

EFFECTS OF THE INVENTION

Use of an image forming apparatus according to the present invention, which keeps exposure by the transfer-exposure apparatus within the range (transfer range) for effective working of the toner attraction force by the discharge from the discharge wire of a transfer apparatus, ensures excellent transfer efficiency and separation performance, prevents scattering of toner from occurring at the time of transfer and provides a high-quality image, free from bleeding of characters or irregularity of density on the halftone image formed by dots or ghost on the back side caused by the presence or absence of a toner image on the front surface of the transfer material.

The invention claimed is:

1. An image forming apparatus comprising:

a photoconductor being movable for carrying a toner image;

a transfer device, provided with a discharge wire, for transferring the toner image onto a transfer material through discharge from the discharge wire in a transfer area, after a transfer material is superposed with the photoconductor;

a transfer-exposure device for carrying out light exposure of a surface of the photoconductor superposed with the transfer material from the back of the transfer material in the transfer area, the transfer area being an area where discharge from the discharge wire is applied onto the surface of the photoconductor;

a separator for separating the transfer material from the photoconductor after the toner image is transferred; and a controller for controlling the operation of the image forming apparatus;

wherein, distribution of an amount of light on the photoconductor surface from the transfer-exposure device, when the photoconductor surface superposed with the transfer material has reached the transfer area, is arranged such that an integrated value of an amount of exposed light upstream the point where the photoconductor surface is closest to the discharge wire, in a direction of movement of the photoconductor, is 10 through 30% of a total amount of exposed light from the transfer-exposure device, and the end of the exposed light in the upstream side on the photoconductor is within the transfer area.

2. The image forming apparatus of claim 1, further comprising a light blocking member, provided between the transfer-exposure device and the photoconductor, for blocking a part of light from the transfer-exposure device.

3. An image forming apparatus comprising:

a photoconductor being movable for carrying a toner image;

a transfer device, provided with a discharge wire, for transferring the toner image onto a transfer material through discharge from the discharge wire in a transfer area, after a transfer material is superposed with the photoconductor;

a transfer-exposure device for carrying out light exposure of a surface of the photoconductor superposed with the transfer material from the back of the transfer material in the transfer area, the transfer area being an area where discharge from the discharge wire is applied onto the surface of the photoconductor;

a light blocking member, provided between the transfer-exposure device and the photoconductor, for blocking a part of light from the transfer-exposure device;

a separator for separating the transfer material from the photoconductor after the toner image is transferred; and a controller for controlling the operation of the image forming apparatus;

wherein, the controller controls such that light from the transfer-exposure device is applied to the photoconductor surface for the first time when the photoconductor surface superposed with the transfer material has reached the transfer area.

4. An image forming method comprising:

forming a toner image on a photoconductor being movable;

superposing a transfer material with the photoconductor;

transferring the toner image onto the transfer material by discharging from a discharge wire in a transfer area, exposing, with light from a transfer-exposure device, a surface of the photoconductor superposed with the transfer material, from the back of the transfer material in the transfer area, the transfer area being an area where discharge from the discharge wire is applied onto the surface of the photoconductor;

blocking a part of the light from the transfer-exposure device by a light blocking member provided between the transfer-exposure device and the photoconductor; and separating the transfer material from the photoconductor after transferring the toner image; and wherein, the light from the transfer-exposure device is applied to the surface of the photoconductor for the first time when the surface of the photoconductor superposed with the transfer material has reached the transfer area.

5. An image forming method comprising:

forming a toner image on a photoconductor being movable;

superposing a transfer material with the photoconductor;

transferring the toner image onto the transfer material by discharging from a discharge wire in a transfer area, exposing, with light from a transfer-exposure device, a surface of the photoconductor superposed with the transfer material, from the back of the transfer material in the transfer area, the transfer area being an area where discharge from the discharge wire is applied onto the surface of the photoconductor; and separating the transfer material from the photoconductor after transferring the toner image;

wherein, the light from the transfer-exposure device is applied to the surface of the photoconductor for the first time when the surface of the photoconductor superposed with the transfer material has reached the transfer area wherein distribution of an amount of light on the surface of the photoconductor from the transfer-exposure device, when the surface of the photoconductor superposed with the transfer material has reached the transfer area, is arranged such that an integrated value of an amount of exposed light upstream the point where the surface of the photoconductor is closest to the discharge wire, in the direction of movement of the photoconductor, is 10 through 30% of a total amount of exposed light from the transfer-exposure device, and the end of the exposed light on the upstream side is within the transfer area.

* * * * *